US005484059A

United States Patent [19]

Sutherland

[11] Patent Number: 5,484,059

[45] Date of Patent: Jan. 16, 1996

[54] CARRIER WITH BOTTOM PANEL LOCK

[75] Inventor: Robert L. Sutherland, Kennesaw, Ga.

[73] Assignee: Riverwood International Corporation, Atlanta, Ga.

[21] Appl. No.: 292,505

[22] Filed: Aug. 18, 1994

[51] Int. Cl.[6] ..... B65D 71/18

[52] U.S. Cl. ..... 206/434; 206/140

[58] Field of Search ..... 206/140, 148, 206/427, 430, 431, 434, 499

[56] References Cited

U.S. PATENT DOCUMENTS

| | | | |
|---|---|---|---|
| 4,077,095 | 3/1978 | Oliff | 206/140 |
| 4,421,232 | 12/1983 | Konaka | 206/434 |
| 4,574,997 | 3/1986 | Ikeda | 206/434 |
| 5,094,347 | 3/1992 | Schuster | 206/434 |
| 5,328,080 | 7/1994 | Holley, Jr. | 206/140 |

*Primary Examiner*—Jimmy G. Foster

[57] ABSTRACT

A wrap-around carrier suitable for packaging tub-shaped articles, The bottom panel is formed from an inner flap to which article retainer flaps are hinged and an outer flap to which a locking tab is hinged, The retainer flaps are pivoted into the interior of the carrier by the locking tabs and include foldable side extensions which engage the bottom portions of adjacent spaced articles, A slit or opening between the retaining flaps permits entry of a locking tab. A projection on the locking tabs engaging the retainer flaps adjacent an edge thereof prevents withdrawal of the locking tabs from their activated positions.

17 Claims, 3 Drawing Sheets

CARRIER WITH BOTTOM PANEL LOCK

FIELD OF THE INVENTION

This invention relates to wrap-around article carriers, and more particularly to article carriers having at least partially open ends and bottom panels formed from bottom panel flaps.

BACKGROUND OF THE INVENTION

Wrap-around article carriers are commonly designed to have ends which are either partially or entirely open. In either case the carriers must be provided with means for preventing the articles from falling out the ends. Beverage cans, for example, are held in place partly by the tension of the tightly wrapped carrier and by engagement of the top and bottom flanges of the cans with the edges of cutouts in the side panels of the carrier through which the flanges of the cans extend. This design is facilitated by the fact that cans have substantially flat tops and bottoms of the same diameter as the body of the can, which allows the carrier blank to be tightly wrapped around the cans.

Problems arise when the articles are not of uniform dimensions, and particularly when the articles are tapered toward the bottom to cause the bottom portions of articles in adjacent rows to be spaced apart. Wrap-around carriers for use with tapered tubs of the type used as soft food containers are especially troublesome because of the difficulty in wrapping them tightly enough to prevent movement of the tubs when the package is lifted and carried. Movement of the containers is a problem even when the carrier includes side slots through which flanges on the tops of the tubs protrude, since such an arrangement does not hold the bottom portions of the tubs tightly in place.

Partial end panels extending up from the bottom panel could be provided to function as article retainers, as could corner end gusset panels or flaps. These measures are not entirely satisfactory, however, because they require extra material to be used, making the carrier more costly to produce, and do not prevent movement of the bottom portions of the containers toward and away from each other. To overcome these problems it has been suggested to provide retaining flaps which are wedged between the bottom portions of adjacent tubs to hold them in place. Although this prevents the spaced bottom portions of articles from moving with respect to each other and toward the open end of the carrier, it requires additional operating steps to activate the flaps. Also, the space taken up by the retaining flaps limits the design of the mechanical locking means employed to secure the bottom panel flaps of the carrier. Such limitations can lead to a greater possibility of the bottom panel flap locking means failing. It would therefore be desirable to provide article retaining means which do not interfere with the operation of bottom panel mechanical locking means and which are not at risk of being moved out of operative condition.

BRIEF SUMMARY OF THE INVENTION

In accordance with the invention, a wrap-around carrier having a top panel and side panels is provided with a bottom panel comprised of overlapping bottom panel flaps foldably connected to the side panels. A first or inner bottom panel flap incorporates hinged article retaining flaps which are folded up into the interior of the carrier so as to engage the bottom portions of adjacent spaced articles. The second or outer bottom panel flap includes bottom panel locking tabs which engage and maintain the retainer flaps in folded operative condition. In addition, the locking tabs include a shoulder extending over an edge of an associated retaining flap to prevent withdrawal of the locking tabs from their engagement with the retaining flaps.

Preferably, each retainer flap includes foldably connected side extensions which contact the bottom portions of adjacent spaced articles. The edges of the retainer flaps associated with the locking tab shoulders extend between the side extensions.

The first bottom panel flap further includes slits which are essentially continuations of slits in the retaining flaps, the combined slits receiving an associated locking tab as it is initially moved into the interior of the carrier during formation of a package. The activated retainer flap is three dimensional, having a central section directed toward the interior of the carrier and the side extensions extending between adjacent end articles. Because the retainer flap fits snugly between the spaced bottom portions of the end articles, the articles are held in place against outward movement. The above and other aspects of the invention, as well as other benefits, will readily be apparent from the more detailed description of the preferred embodiment which follows.

DETAILED DESCRIPTION OF THE PREFERRED EMBODIMENTS

Figure 1:
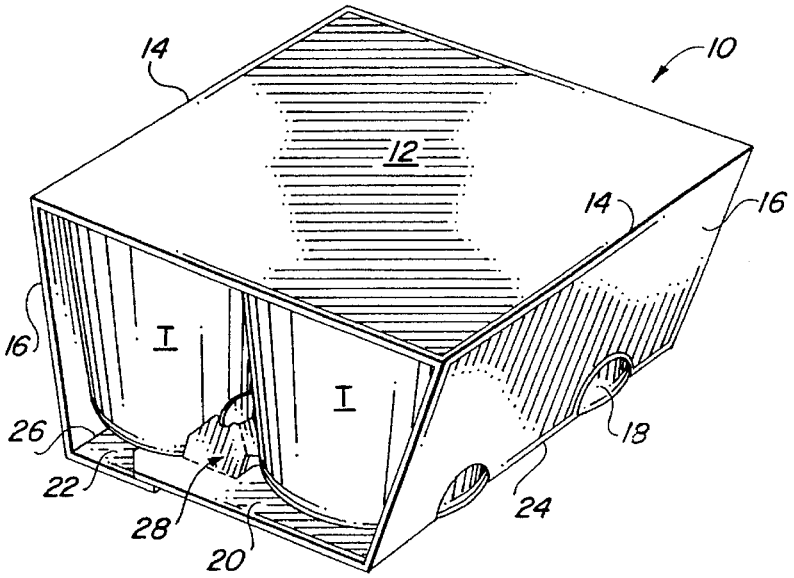
FIG. 1 is a pictorial view of a wrap-around carrier incorporating the article retaining means of the invention.

Referring to FIG. 1, a wrap-around carrier 10 comprises a top panel 12 connected along fold lines 14 to side panels 16 which generally follow the contour of tapered articles T in the carrier. For purpose of illustrating the invention, the articles T are shown as comprising tubs of the type used to contain soft food, such as pudding or margarine or the like. It can be seen that the side panels are inwardly tapered at the bottom portion of the carrier as a result of being tightly wrapped around the sloped side portions of the tubs. The side panels adjacent the bottom panel are provided with cutouts or apertures 18 through which the bottom portions of the tubs T extend.

The bottom panel is formed by overlapped inner and outer bottom panel flaps 20 and 22. The inner bottom panel flap 20 is connected to one of the side panels 16 along fold line 24 while the outer bottom panel flap 22 is connected to the other side panel 16 along fold line 26. Extending up from the bottom panel adjacent the end articles T in the adjacent rows of articles is a retainer flap 28. The retainer flap is contoured, as described more fully below, and fits snugly between the angled bottom portions of the articles T, preventing the bottom portions from moving either toward the open end of the carrier or in a transverse direction away from the side panels 16.

Figure 2:
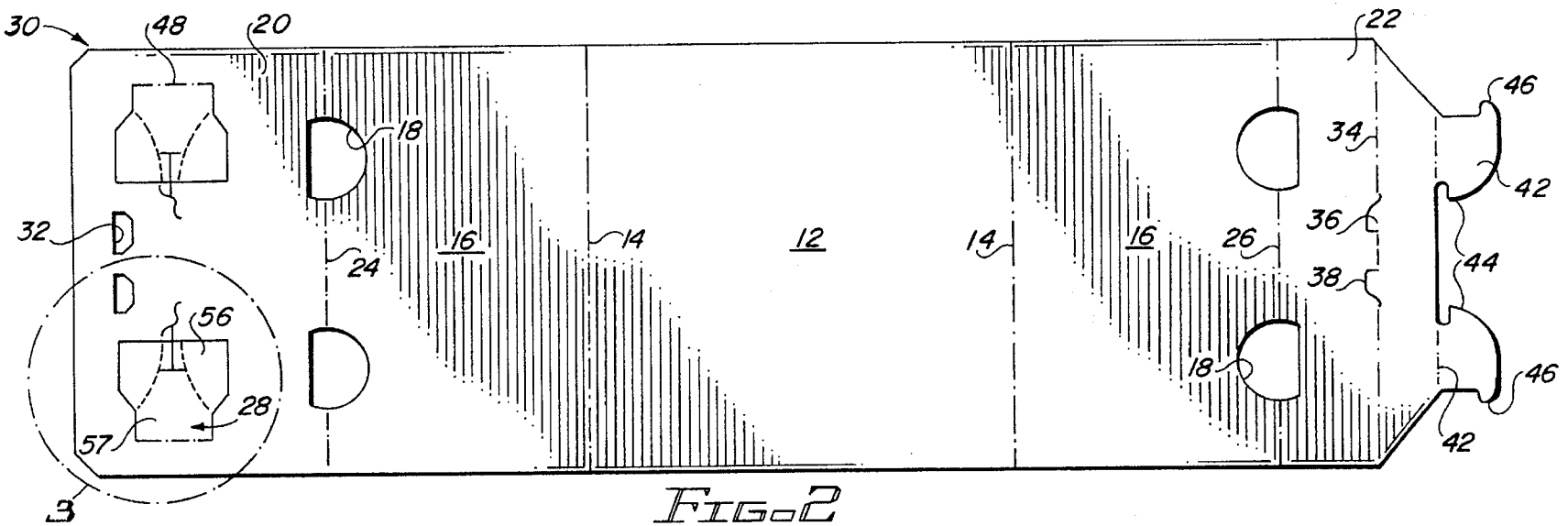
FIG. 2 is a plan view of a blank for forming the carrier of FIG. 1.

As shown in FIG. 2, wherein like reference numerals to those used in FIG. 1 denote like elements, a blank for forming the carrier 10 comprises a substantially rectangular sheet 30 of paperboard or other suitable material having adequate flexibility and strength, with the top panel section 12 being centrally located and the other panel sections described above being successively connected along the fold lines referred to above. The inner bottom panel flap 20 incorporates the retainer flaps 28 at opposite ends as well as primary female locking openings 32 between the flaps. The outer bottom panel flap 22 includes a fold line 34 spaced from and parallel to the fold line 26. Primary locking tabs 36 are formed by slits 38 which interrupt the fold line 32. Two spaced secondary locking tabs 40 are connected to the flap 22 along fold lines 42. The edges of the locking tabs 40 that face each other curve toward the blank and terminate adjacent the end edge of the bottom panel flap 22 in spaced shoulders 44, while the edges of the tabs facing away from each other terminate in projections such as catch hooks or shoulders 46.

Figure 3:
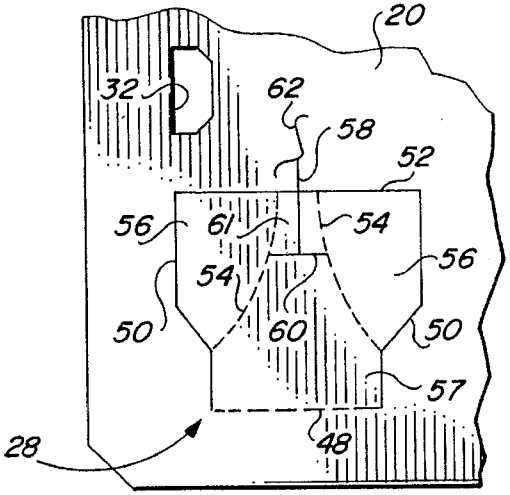
FIG. 3 is an enlarged plan view of the portion of FIG. enclosed in the circle 3.

Referring back to the opposite end of the blank of FIG. 2 and to FIG. 3, each retainer flap structure 28 is connected to the inner bottom panel flap 20 by a fold line 48 which is spaced from and substantially parallel to an end edge of the flap 20. Identical slits 50 extend transversely from the ends of the fold line 48 and connect with the ends of slit 52, which is parallel to the fold line 48. Curved fold lines 54 extend from spaced points on the slit 52 to points on the slits 50 to form identical spaced extensions 56 of the retainer flap. The main body 57 of the retainer flap is thus connected to the bottom panel flap 20 by the fold line 48 and extends between the extensions 56. A slit 58 extends from outside the retainer flap structure into the narrow neck of the retainer flap body between the extensions 56 and terminates in a cross slit 60 to form a T-shaped cut. The portions of the retainer flap connected to the fold line 54 and slits 58, 60 and 52 comprise flaps or wings 61. In addition, an S-shaped slit 62 in the bottom panel flap 20 connects with the end of the slit 58 located outside the retainer flap 28.

Figure 4:
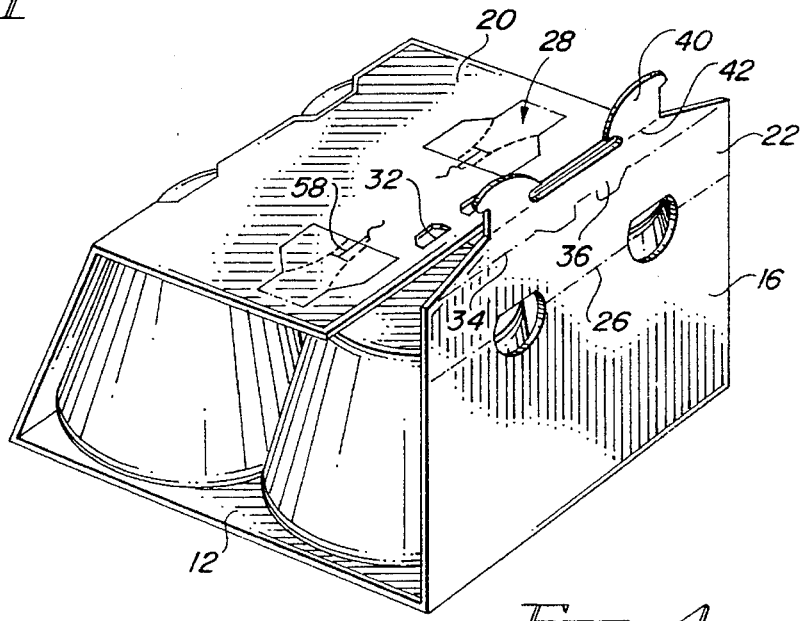
FIG. 4 is a pictorial view of the carrier showing the bottom panel flaps at an initial stage of assembly.

To form a carrier the blank 30 is wrapped around the tubs or other articles to be packaged with the inner bottom panel flap 20 folded down against the bottoms of the tubs and the outer bottom panel flap 22 folded back along fold line 34 as illustrated in FIG. 4. This moves the primary locking tabs 36 out Of the plane of the bottom panel flap 22. With the primary locking tabs 36 thus exposed, the outer bottom panel flap 22 is folded down about the fold line 26 and the tabs 36 are caused to enter the primary locking openings 32 of the inner bottom panel flap. The outer portion of the outer bottom panel flap is then folded down about fold line 34 and the secondary locking tabs 40 are folded down about their fold lines 42 so as to enter the slits 58. Although it is not essential that the S-shaped slits 62 be provided at the ends of the slits 58, this structure is preferred because it enables the locking tabs 40 to readily enter the slits while providing a degree of protection against subsequent withdrawal. As can be understood from FIG. 5, which illustrates the location of a locking tab 40, shown in broken lines, as it is about to enter an associated slit 58, the tabs 40 push aside the small tabs 64 formed by the S-shaped slits as the tabs 40 enter the slits 58. Then when the small tabs snap back to their original position after the shoulder 44 of the locking tabs 40 have passed, they prevent easy withdrawal of the locking tabs.

Figure 6:
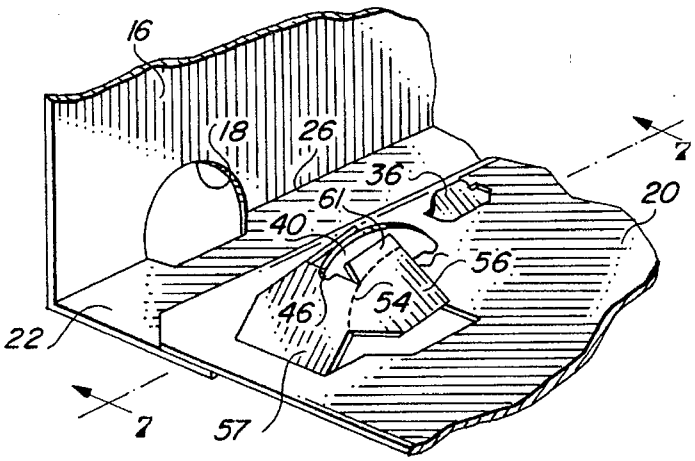
FIG. 6 is an enlarged partial pictorial view of the inside of one end of the carrier, with the packaged articles omitted for purpose of clarity.
Figure 8:
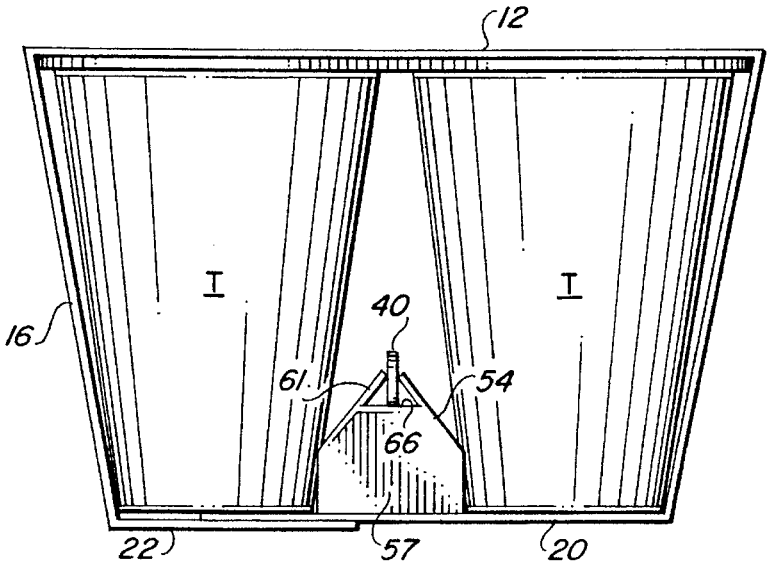
FIG. 8 is an enlarged end view of the carrier, showing the retaining means in activated condition.
Figure 5:
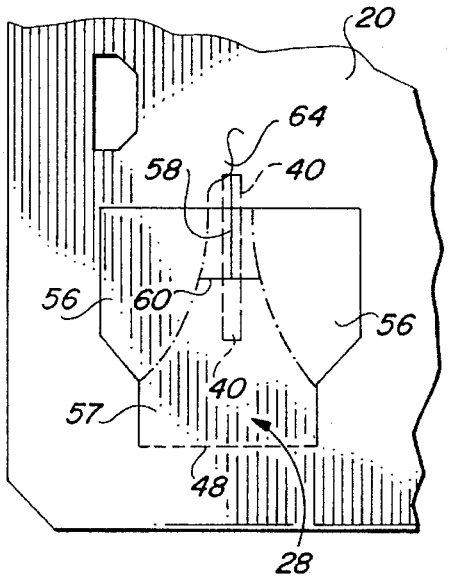
FIG. 5 is an enlarged plan view similar to that of FIG. 3, but showing the position of a locking tab and a slit in the inner bottom panel flap just prior to the tab entering the slit.
Figure 7:
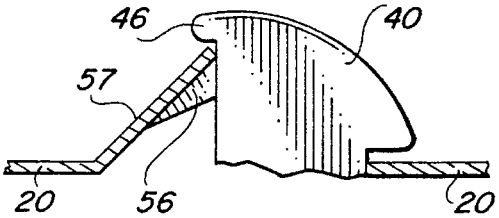
FIG. 7 is a sectional view taken on line 7-7 of FIG.

It will be clear from FIG. 5 that as the tabs 40 enter the portions of the slits 58 in the bottom panel 20, the outer portions of the tabs engage the main retainer flap bodies 57 and pivot them into the interior of the carrier about the fold lines 48. Because the retainer flaps are located between the bottoms of the two rows of tubs, the retainer flaps are able to freely move in this manner in the space between the rows of tubs. As the main retainer flap bodies 57 pivot toward the top panel and the open ends of the carrier, the foldable extensions 56 contact the adjacent tubs and are caused to fold up about the fold lines 54. As the retainer flap bodies move toward the adjacent open ends of the carrier the portions of the slits 58 separating the wings 61 also move closer to the ends of the carrier until a point is reached where the ends of the cross hooks 46 of the tabs 40 no longer engage the flap bodies 57 but pass through these slits. When this occurs the bias of the fold lines 48 toward their closed positions causes the flap bodies 57 to snap back toward each other, causing the edges formed by the cross slits 60 to be located beneath the hooks or projections 46. This final condition is illustrated in FIG. 6, which omits the tubs in order that the relationship between the retainer tab structure and the secondary locking tab 40 can more clearly be seen. It is also shown in the sectional view of FIG. 7 and in the end view of the completed carrier of FIG. 8o As shown in these drawing figures, contact between the hook 46 and the edge 66 formed by the slit 60 in the flap body 57 prevents withdrawal of the tabs 40 from their locked positions.

Figure 9:
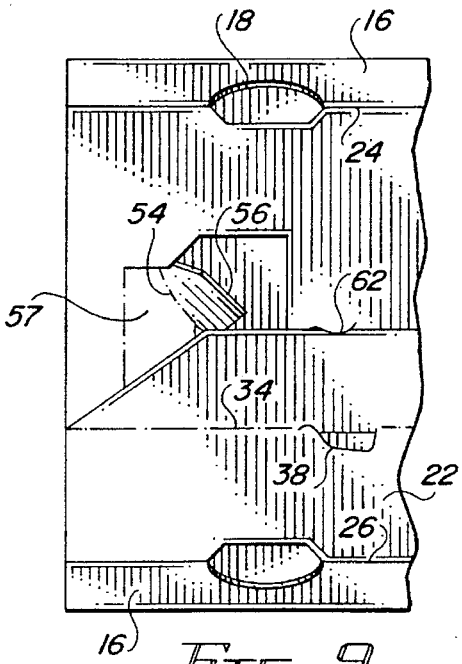
FIG. 9 is an enlarged partial plan view of the bottom panel of the carrier.

The final position of the retainer tab structure is also illustrated in FIG. 9, which shows the bottom of the carrier of FIG. 1. Note that the structure visible in this view is seen through the opening in the bottom panel flap 20 which has been vacated by the inward pivoting of the retainer flap structure.

Figure 10:
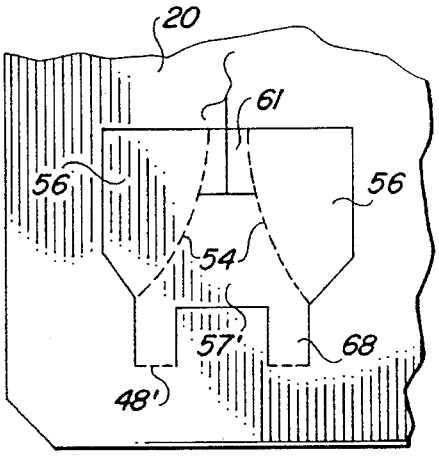
FIG. 10 is an enlarged plan view similar to that of FIG. 3, but illustrating a modified arrangement.

It is contemplated that the main retainer flap bodies may be modified as shown in FIG. 10, wherein the flap body 57' is connected to the bottom panel flap 20 by short fold lines 48' separated by a cutout in the flap body, thus forming legs 68. This arrangement requires less force to fold the flap body into operative position and may be employed where this is a concern.

It will be understood that the dimensions of the retaining flap and the location of the side extension fold lines are selected to cause the retainer flap extensions to engage and be folded against adjacent articles in the carrier. It is preferred that the wing flaps 61 be present for the extra stability and the additional support surface which they provide. It will be appreciated, however, that even if they were eliminated, so that a cutout area is provided in their place, the locking tabs 40 would still be positioned with respect to the retainer flap edge 64 so as to prevent withdrawal of the locking tabs from the retainer flaps.

It can be appreciated that the article retaining means of the invention provides an effective retainer which engages substantial portions of the end tubs or other articles in a carrier which have spaced bottom portions, and does so without adding to the material cost of the carrier blank. In addition, the retaining means provides an additional mechanical lock between the flaps forming the bottom panel, thus further ensuring against the accidental escape of articles from the carrier through failure of the bottom panel. Although not illustrated, it will be understood that the top panel may be provided with handle openings if desired, to facilitate lifting and carrying.

While the invention has been illustrated in connection with tub-shaped articles, it may also be employed to hold articles of different shapes, including beverage bottles and cans, against outward movement in a carrier.

It should now be apparent that the invention need not be limited to all the specific details described in connection with the preferred embodiments, but that changes to certain features of the preferred embodiments which do not alter the overall basic function and concept of the invention may be made without departing from the spirit and scope of the invention, as defined in the claims.

What is claimed is:

1. A wrap-around article carrier containing a plurality of adjacent rows of articles the bottom portions of which are spaced apart, comprising:

a top panel;

opposite side panels connected to the top panel;

a bottom panel comprised of a first bottom panel flap connected at a side edge thereof to one of the side panels and a second bottom panel flap connected at a side edge thereof to the other side panel, each bottom panel flap having opposite end edges;

the first bottom panel flap including an integral article retainer flap hinged thereto adjacent each end edge of the first bottom panel flap, the article retainer flaps being folded up from the first bottom panel flap into the interior of the carrier so as to engage the bottom portions of adjacent spaced articles;

the second bottom panel flap including a locking tab associated with each retainer flap, each retainer flap engaging an associated locking tab to maintain the retainer flap in folded condition;

a shoulder on each tab extending over an edge of the associated retainer flap for preventing withdrawal of the locking tabs from engagement with the retainer flaps; and each retainer flap including side extensions connected on opposite sides thereof along fold lines, the side extensions contacting the bottom portions of adjacent spaced articles.

2. A wrap-around article carrier as defined in claim 1, wherein said edge of each retainer flap engages an associated tab beneath the shoulder thereon to maintain the retainer flap in folded condition.

3. A wrap-around article carrier as defined in claim 1, wherein said edge of each retainer flap extends between the side extensions.

4. A wrap-around article carrier as defined in claim 3, wherein each retainer flap includes two spaced wing flaps connected by fold lines to opposite side extensions, the wing flaps engaging opposite sides of an associated locking tab.

5. A wrap-around article carrier as defined in claim 4, wherein each wing flap includes an edge which is spaced from said edge of an associated retainer flap.

6. A wrap-around article carrier as defined in claim 1, wherein the first bottom panel flap includes cutouts resulting from the inward folding of the retaining flaps, the first bottom panel flap further including slits extending toward each other from edges of the cutouts, each slit enabling at least a portion of an associated locking tab to pass therethrough as the locking tabs are moved into the interior of the carrier.

7. A wrap-around carrier as defined in claim 1, wherein the locking tabs are secondary locking tabs, the second bottom panel flap containing at least one primary locking tab engaging a primary locking opening in the first bottom panel flap.

8. A wrap-around carrier as defined in claim 1, wherein the locking tab is foldably connected to the second bottom panel flap.

9. A wrap-around carrier as defined in claim 1, wherein the article retainer flaps are hingedly connected to the first bottom panel flap along fold lines which are substantially parallel to the end edges of the first bottom panel flap.

10. A blank for forming a wrap-around carrier for packaging a plurality of adjacent rows of articles the bottom portions of which are spaced apart, comprising:

a generally rectangular sheet having a central top panel section;

side panel sections connected to opposite sides of the top panel section by fold lines;

a first bottom panel flap connected to one of the side panel sections along a first fold line and a second bottom panel flap connected to the other side panel section along a second fold line, each bottom panel flap having opposite end edges;

the first bottom panel flap including an article retainer flap hinged thereto adjacent each end edge of the first bottom panel flap;

the second bottom panel flap including a locking tab for engaging an associated locking tab in the first bottom panel flap in a carrier formed from the blank to fold the retainer flap into the interior of the carrier and to maintain the retainer flap in folded condition;

a shoulder on each tab underlying an edge of an associated retainer flap in a carrier formed from the blank for preventing withdrawal of the locking tabs from engagement with the retainer flaps; and each retainer flap including side extensions connected on opposite sides thereof along fold lines, the side extensions contacting the bottom portions of adjacent spaced articles in a carrier formed from the blank.

11. A wrap-around carrier blank as defined in claim 10, wherein said edge of each retainer flap extends between the side extensions.

12. A wrap-around carrier blank as defined in claim 11, wherein each retainer flap includes two wing flaps connected by fold lines to opposite side extensions and separated by a slit, the wing flaps engaging opposite sides of an associated locking tab in a carrier formed from the blank.

13. A wrap-around carrier blank as defined in claim 12, wherein the first bottom panel flap includes slits which are substantially continuations of the slit separating adjacent wing flaps, each said continuation slit enabling at least a portion of an associated locking tab to pass therethrough as the locking tabs are moved into the interior of a carrier formed from the blank.

14. A wrap-around carrier blank as defined in claim 10, wherein the locking tabs are secondary locking tabs, the second bottom panel flap containing at least one primary locking tab for engaging a primary locking opening in the first bottom panel flap.

15. A wrap-around carrier blank as defined in claim 10, wherein the locking tab is foldably connected to the second bottom panel flap.

16. A wrap-around carrier blank as defined in claim 10, wherein the article retainer flaps are hinged to the first bottom panel flap along fold lines which are substantially parallel to the end edges of the first bottom panel flap.

17. A wrap-around article carrier containing a plurality of adjacent rows of articles the bottom portions of which are spaced apart, comprising:

a top panel;

opposite side panels connected to the top panel;

a bottom panel comprised of a first bottom panel flap connected at a side edge thereof to one of the side panels and a second bottom panel flap connected at a side edge thereof to the other side panel, each bottom panel flap having opposite end edges;

the first bottom panel flap including an integral article retainer flap hinged thereto adjacent each end edge of the first bottom panel flap, the article retainer flaps being folded up from the first bottom panel flap into the interior of the carrier so as to engage the bottom portions of adjacent spaced articles;

the second bottom panel flap including a locking tab associated with each retainer flap, each retainer flap engaging an associated locking tab to maintain the retainer flap in folded condition;

means for preventing withdrawal of the locking tabs from engagement with the retainer flaps;

the retainer flaps being hingedly connected to the first bottom panel flap along fold lines which are substantially parallel to the end edges of the first bottom panel flap; and each article retainer flap including a cutout forming spaced legs, the spaced legs being hingedly connected to the first bottom panel flap along said fold lines.

* * * * *